United States Patent [19]

Delaney et al.

[11] 4,414,104

[45] Nov. 8, 1983

[54] PROCESS FOR REMOVAL OF METALS FROM HYDROCARBON OILS

[75] Inventors: Dennis D. Delaney, Placentia; Donald M. Fenton, Anaheim, both of Calif.

[73] Assignee: Union Oil Company of California, Brea, Calif.

[21] Appl. No.: 374,717

[22] Filed: May 4, 1982

[51] Int. Cl.[3] ..... C10G 17/09

[52] U.S. Cl. ..... 208/251 R

[58] Field of Search ..... 208/251 R

[56] References Cited

U.S. PATENT DOCUMENTS

| | | | |
|---|---|---|---|
| 2,411,958 | 12/1946 | Dietrich et al. | 208/251 R |
| 2,411,959 | 12/1946 | Dietrich et al. | 208/251 R |
| 2,683,683 | 7/1954 | Mills | 208/251 R |
| 2,703,306 | 3/1955 | Asselin | 208/251 R |
| 2,778,777 | 1/1957 | Powell | 208/251 R |
| 2,854,399 | 9/1958 | Weller | 208/250 |
| 2,926,129 | 1/1960 | Kimberlin, Jr. et al. | 208/251 R |
| 2,969,320 | 1/1961 | Shapiro et al. | 208/251 R |
| 3,303,126 | 2/1967 | Gleim | 208/251 H |
| 3,562,151 | 2/1971 | Langlois et al. | 208/251 R |
| 3,849,297 | 11/1974 | Long | 208/251 R |

*Primary Examiner*—Delbert E. Gantz
*Assistant Examiner*—Cynthia A. Prezlock
*Attorney, Agent, or Firm*—Alan H. Thompson; Daniel R. Farrell; Dean Sandford

[57] ABSTRACT

A thiocyanate compound is added to metals-containing hydrocarbon oils under reaction conditions, and a product hydrocarbon of reduced metals content is separated from a metals-containing solid.

14 Claims, No Drawings

PROCESS FOR REMOVAL OF METALS FROM HYDROCARBON OILS

BACKGROUND OF THE INVENTION

1. Field of the Invention

The present invention relates to the refining of hydrocarbons and particularly to the upgrading of hydrocarbon oils containing organometallic components by removing contaminant metals therefrom. More particularly, the invention relates to producing hydrocarbon products containing low concentrations of contaminant metals from oils containing high concentrations of metals.

2. Description of the Prior Art

Various hydrocarbon-containing oils which require refining, such as crude petroleum and syncrude oils, heavy vacuum gas oils, shale oils, oils from bituminous sands, topped crudes, and atmospheric or vacuum residual fractions, often contain varying amounts of metallic contaminants, such as vanadium, nickel, copper, iron, sodium, and zinc. A substantial proportion of the metals contained in such oils, especially in the asphaltene fraction thereof, are in the form of organometallic components, principally metal porphyrins and derivatives thereof. During the refining of such oils subjected to a catalytic treatment, some of the organometallic components undergo chemical reactions resulting in deposition of contaminant metals on the catalyst. The deposition of metals on the catalyst proves detrimental to many refining catalysts, causing deactivation thereof and/or loss of selectivity for yielding an intended product. In the usual instance, the extent of deactivation and/or selectivity loss is a function of the amount of metals deposition, i.e., the usefulness of the catalyst steadily decreases as the amount of deposited metals increases with continued treatment of the oil.

Ordinarily, removal of metal contaminants from oils by thermal treatment also includes the production of coke. Usually it is uneconomical to remove metal contaminants from oils if too much coke is also produced.

It is an object of this invention to provide a process for removing metal contaminants from oils. A further object is to provide hydrocarbon products of reduced metals content so as to extend the life of downstream refining catalysts.

It is another object of this invention to provide a process involving thermal treatment, for removing metal contaminants from oils but with a minimum of coke production. These and other objects and advantages of the invention will become apparent from the following description.

SUMMARY OF THE INVENTION

Briefly, the invention provides a method for removing metals from hydrocarbon-containing oils by contacting metals-containing oils under reaction conditions with a thiocyanate compound and separating a metals-containing solid from a product hydrocarbon of reduced metals content as compared to the oil. In one embodiment, an oil-soluble thiocyanate compound is added to the oil and the resultant blend subjected to reaction conditions forming a metals-containing solid, which is then separated from the product hydrocarbon. In a typical embodiment of the invention, ammonium thiocyanate is added to the oil and the resultant blend subjected to a temperature of about 250° C. to about 500° C. for a sufficient residence time to obtain metals-containing solids that are separated from a product hydrocarbon of reduced metals content.

DETAILED DESCRIPTION OF THE INVENTION

In accordance with the invention, contaminant metals are removed from hydrocarbon oils by contacting metals-containing oils under reaction conditions with a thiocyanate compound and separating the resulting metals-containing solid from the product hydrocarbon.

Contemplated for treatment by the process of the invention are hydrocarbon-containing oils, herein referred to generally as "oils," including broadly all liquid and liquid/vapor hydrocarbon mixtures such as crude petroleum oils and synthetic crudes. Among the typical oils contemplated are topped crudes, and vacuum and atmospheric residual fractions, heavy vacuum distillate oils, shale oils, oils from bituminous sands, coal compositions, and the like, which contain one or more of such metals as vanadium, nickel, iron, sodium, zinc, and copper. Typically, any metals-containing hydrocarbon oils, preferably containing in excess of 2 ppmw of total contaminant metals, may be treated in accordance with the invention, but since the metallic poisons which deactivate hydrocarbon refining catalysts are generally associated with the asphaltene components of the oil, the process will be more commonly applied to the higher boiling fractions in which the asphaltene components concentrate. The process of the invention is especially useful for treating oils containing more than about 50 ppmw of nickel plus vanadium contaminant metals, as for example, atmospheric and vacuum distillation residua which contain a substantial proportion of asphaltenes. Such heavy metal-contaminated oils commonly have an API gravity between 6 and 30 degrees, and usually between 10 and 25 degrees.

In accordance with the invention, a thiocyanate compound is contacted with the metals-containing oil. The more suitable thiocyanate compounds are soluble in the oil, and the preferred thiocyanate compounds are soluble in both water and the oil. Among the more preferred thiocyanate compounds are alkali or alkaline earth-metal thiocyanates, ammonium thiocyanate, alkylated ammonium thiocyanates, and aromatic ammonium thiocyanates. More particularly, the thiocyanate compounds preferred include ammonium thiocyanate, sodium thiocyanate, potassium thiocyanate, calcium thiocyanate, methylammonium thiocyanate, dimethylammonium thiocyanate, trimethylammonium thiocyanate, tetramethylammonium thiocyanate, tributylammonium thiocyanate, methyltriethylammonium thiocyanate, methyl-n-dibutylammonium thiocyanate, trimethyl-2-hydroxyethylammonium thiocyanate, ethylammonium thiocyanate, dithiocyanates, phenyltrimethylammonium thiocyanate, and mixtures thereof.

Due to its appreciable solubility in water and most oils, ammonium thiocyanate is the most highly preferred thiothiocyanate-containing agent for use in the invention. The ammonium thiocyanate may be added directly to the oil in solid or molten form or added with an aqueous solution. Alternatively, it may be generated in situ by contact with recycled downstream products including sulfur, hydrogen cyanide, and ammonia. Such products are readily available in streams from stripping units or other refinery apparatus utilized to separate hydrocarbon effluents of refinery processes such as catalytic cracking, hydrogen processing, and denitrification or desulfurization.

The amount of the thiocyanate compound added generally depends upon the amount of metals contained in the oil and the amount of demetallation desired. The thiocyanate compound is blended with the oil in amounts such that the resulting thiocyanate to total contaminant metals mole ratio is between about 0.5 and 100, preferably 1 and 20, and most preferably 1.5 and 5, thiocyanate ion to total contaminant metals, expressed as the free elements.

The thiocyanate-oil blend is subjected to reaction conditions, which typically include an elevated temperature, a pressure sufficient to maintain the blend of oil and thiocyanate compound in the liquid phase, and an oil-thiocyanate residence time sufficient to produce the metals-containing solid. The temperature usually required is about 250° C. to about 500° C., preferably about 350° C. to about 450° C., and most preferably about 370° C. to about 420° C. The operating pressure is normally maintained between about atmospheric and 4,000 p.s.i.g., sufficient to provide for reaction in the liquid phase, preferably under an inert atmosphere, e.g., nitrogen, or in the presence of hydrogen, steam, or other agents for reducing coke formation. The oil-thiocyanate residence time is usually from about 0.1 to about 6 hours, preferably about 0.75 to 4 hours, and most preferably about 1 to about 2 hours.

Reaction of the metal and organometallic components of the oil with the thiocyanate compound produces a metals-containing solid that does not appreciably dissolve in toluene. The solid is believed to be formed by the thiocyanate compound mildly oxidizing the organometallic components. The solid comprises contaminant metal components and coke, the latter in an amount most preferably less than 1 weight percent, preferably less than about 3 weight percent, and usually less than 5 weight percent of the oil; however, a greater amount of coke may be produced depending upon the nature of the oil and reaction conditions. Among the conditions contributing to lower coke production are the presence of water in the reaction zone, relatively low heat induction and cooling rates, and pressuring atmospheres containing gases reactive with the oil such as hydrogen, steam, syngas-steam, and the like.

Metals-containing solids produced in accordance with the invention may be separated from the hydrocarbon oil in any of a variety of ways. Typical separation techniques include fractionation procedures such as deasphalting and desalting; also useful are filtration, centrifuging, and electrostatic separation procedures, with electrostatic separation being preferred.

After a product hydrocarbon has been produced by one of the foregoing separation techniques, or a combination thereof, the product hydrocarbon may then either be recovered or, prior thereto, be treated for removal of excess thiocyanate compound. This latter embodiment of the invention is employed to particular advantage when the thiocyanate compound is water-soluble. A water solution may be utilized to extract the excess thiocyanate compound, and optionally, the extractant is recycled to the oil-thiocyanate reaction zone as a source of thiocyanate. This embodiment has the advantage of not only conserving thiocyanate, but also contributing to reduced coke production in the reaction zone.

In one embodiment of the invention, the thiocyanate compound is blended with the oil in an amount such that the resulting thiocyanate to total contaminant metals mole ratio is about 0.5 to 100. The thiocyanate-oil blend is subjected to reaction conditions including an elevated temperature between about 250° C. and about 500° C., a pressure sufficient to maintain the thiocyanate-oil blend in the liquid phase, i.e., about atmospheric to about 4,000 p.s.i.g., and a residence time, usually about 0.1 to about 6 hours, i.e., time sufficient to produce a metals-containing solid and a product hydrocarbon containing less metals than the oil. The metals-containing solid, comprising contaminant metal components and coke, is then separated from the product hydrocarbon.

In a preferred embodiment, an oil containing more than 50 ppmw of nickel plus vanadium contaminant metals is blended with ammonium thiocyanate in an amount such that the resulting thiocyanate to total contaminant metals mole ratio is about 1.5 to about 5. The oil-thiocyanate blend is subjected to reaction conditions including an elevated temperature between about 370° C. and about 420° C., a pressure of about 1,000 p.s.i.g. hydrogen, and an oil-thiocyanate residence time of about 1 to about 2 hours. Under such conditions is produced a metals-containing solid comprising coke in an amount less than 3 weight percent of the oil and a product hydrocarbon containing a substantially lower total contaminant metals content than the oil. The product hydrocarbon is filtered from the solid, and any excess thiocyanate in the product hydrocarbon may be extracted for recycle.

In another embodiment of the invention, shale oil containing in excess of 2 ppmw of contaminant metal is contacted with a soluble thiocyanate compound under reaction conditions including an elevated pressure and a temperature from about 350° C. to about 450° C., and an oil-thiocyanate residence time of about 0.75 to about 4 hours. The reaction produces a metals-containing solid that is electrostatically separated from a product hydrocarbon of reduced metal content as compared to the shale oil.

The invention is further illustrated by the following examples which are illustrative of specific modes of practicing the invention and are not intended as limiting the scope of the appended claims.

EXAMPLE 1

The removal of metals from a hydrocarbon feedstock, the properties of which are shown in Table I, is illustrated by adding ammonium thiocyanate to the feedstock and subjecting the resultant blend to an elevated temperature and pressure.

TABLE I

| FEEDSTOCK PROPERTIES | |
|---|---|
| Feed Description | Maya Crude |
| Gravity, ÅPI | 22.6 |
| Sulfur, wt. % | 3.32 |
| Nitrogen, wt. % | 0.30 |
| Pour Point, ° F. | −40 |
| Conradson Carbon, wt. % | 11.0 |
| Vanadium, ppmw | 279 |
| Nickel, ppmw | 50 |

Twenty-seven (27) grams of an aqueous solution containing 2 grams of ammonium thiocyanate is added to 50 grams of the above-mentioned Maya Crude feedstock in a glass-lined autoclave and subjected to a nitrogen pressure of 400 p.s.i.g. The admixture is gradually heated for one hour to a temperature of 385° C. and held for 4 hours. Primarily due to the presence of water vapor, the pressure increases to about 3,000 p.s.i.g. during the 4-hour reaction time and returns to about 400 p.s.i.g. during a gradual 1-hour cool-down period. Five hundred milliliters of toluene is then added to the reaction sample and 0.4 grams of solid material is recovered by filtration from a toluene solution containing the remaining product hydrocarbon. After 500 ml of essentially metal-free distillate, primarily toluene, is evaporated, the product hydrocarbon is analyzed by X-ray fluorescence techniques and shown to contain 90 ppmw of vanadium metal and 16 ppmw of nickel metal, i.e., about 68 percent vanadium or nickel metal removal from the above-mentioned feedstock.

EXAMPLE 2

Modification of the reactor vessel and reaction conditions from Example 1 illustrates similar demetallation of the same Maya Crude feedstock.

A blend of 4.32 grams of ammonium thiocyanate and 480 grams of the Maya Crude feedstock is passed through a 250-ml tubular reactor having an inside diameter of 0.76 inches and 3 feet in length at a rate of 157 grams/hour at a reaction temperature of 407° C. while being subjected to a 1,000 p.s.i.g. of hydrogen gas delivered at a rate of 1.5 SCF/hr. The residence time of the thiocyanate-Maya Crude is 1.6 hours.

A toluene-insoluble solid, 12.2 grams, is recovered from the reactor, i.e., 2.6 weight percent of the feedstock. The solid is analyzed and shown to contain 0.21 weight percent of vanadium and 0.07 weight percent of nickel, both calculated as the free element. The remaining product hydrocarbon liquid is analyzed and shown to contain 90 ppmw of vanadium metal and 17 ppmw of nickel metal, i.e., about 66 percent of vanadium or nickel metal removal from the Maya Crude feedstock.

While particular embodiments of the invention have been described, it will be understood, of course, that the invention is not limited thereto since many obvious modifications can be made, and it is intended to include within this invention any such modifications as will fall within the scope of the appended claims.

We claim:

1. A process for removing metals from a hydrocarbon oil comprising contacting a metals-containing hydrocarbon oil with a thiocyanate compound under reaction conditions including a temperature of about 250° C. to about 500° C. producing a metals-containing solid and a product hydrocarbon of reduced metals content in comparison to said oil, and separating said metals-containing solid from said product hydrocarbon.

2. The process as defined in claim 1 wherein said thiocyanate compound is selected from the group consisting of ammonium thiocyanate, potassium thiocyanate, sodium thiocyanate, aromatic ammonium thiocyanates, and alkylated ammonium thiocyanates.

3. The process as defined in claim 1 wherein said metals-containing hydrocarbon oil comprises asphaltenes.

4. The process as defined in claim 1 wherein said metals comprise vanadium or nickel.

5. The process as defined in claim 1 wherein said thiocyanate compound is soluble in said oil.

6. The process as defined in claim 1 wherein said metals-containing solid comprises coke, said coke being less than 5 weight percent of said oil.

7. A process for recovering a product hydrocarbon from a metals-containing hydrocarbon oil, said process comprising:

(1) contacting said oil with a thiocyanate compound selected from the group consisting of ammonium thiocyanate, potassium thiocyanate, sodium thiocyanate, aromatic ammonium thiocyanates, and alkylated ammonium thiocyanates under reaction conditions including a temperature of about 250° C. to about 500° C.;

(2) producing a metals-containing solid and a product hydrocarbon of reduced metals content as compared to said oil;

(3) separating said metals-containing solid and said product hydrocarbon; and (4) recovering said product hydrocarbon.

8. A process for removing contaminant metals comprising nickel and vanadium from a hydrocarbon oil containing a substantial proportion of asphaltenes, said process comprising:

(1) contacting said oil with ammonium thiocyanate at a temperature of about 350° C. to about 450° C., said contacting occurring for a time sufficient to produce a metals-containing solid having a substantial proportion of said contaminant metals and a product hydrocarbon of reduced metals content as compared to said hydrocarbon oil;

(2) separating said metals-containing solid from said product hydrocarbon; and (3) recovering said product hydrocarbon.

9. The process as defined in claim 7 or 8 wherein step (1) further comprises the presence of water.

10. The process as defined in claim 7 or 8 further comprising removing excess thiocyanate from said product hydrocarbon and recycling a portion thereof to said oil.

11. The process as defined in claim 8 wherein said ammonium thiocyanate is generated in situ prior to step (1) by contact in said oil with recycled downstream refining products.

12. The process as defined in claim 7 or 8 wherein said metals-containing solid comprises coke, said coke comprises less than about 3 weight percent of said oil.

13. The process as defined in claim 7 or 8 wherein said oil comprises shale oil.

14. A process for removing metals from a shale oil comprising contacting a metals-containing shale oil with a thiocyanate compound under reaction conditions including a temperature of about 250° C. to about 500° C. producing a metals-containing solid and a product hydrocarbon of reduced metals content in comparison to said shale oil, and separating said metals-containing solid from said product hydrocarbon.

* * * * *